US012152603B2

(12) United States Patent
Henke et al.

(10) Patent No.: US 12,152,603 B2
(45) Date of Patent: Nov. 26, 2024

(54) COMPRESSOR

(71) Applicant: BorgWarner Inc., Auburn Hills, MI (US)

(72) Inventors: Waldemar Henke, Ludwigsburg (DE); Sebastian Dauscher, Ludwigsburg (DE)

(73) Assignee: BorgWarner Inc., Auburn Hills, MI (US)

( * ) Notice: Subject to any disclaimer, the term of this patent is extended or adjusted under 35 U.S.C. 154(b) by 141 days.

(21) Appl. No.: 17/853,369

(22) Filed: Jun. 29, 2022

(65) Prior Publication Data

US 2023/0383764 A1 Nov. 30, 2023

(30) Foreign Application Priority Data

May 25, 2022 (DE) ..... 10 2022 113 227.7

(51) Int. Cl.
*F04D 29/58* (2006.01)
*F04D 25/06* (2006.01)

(52) U.S. Cl.
CPC ..... *F04D 29/5806* (2013.01); *F04D 25/06* (2013.01); *F04D 29/582* (2013.01)

(58) Field of Classification Search
CPC ..... F04D 29/5806; F04D 29/4206; F04D 29/0513
See application file for complete search history.

(56) References Cited

U.S. PATENT DOCUMENTS

| | | | | |
|---|---|---|---|---|
| 10,069,154 | B2 | 9/2018 | Metz et al. | |
| 2013/0259720 | A1 | 10/2013 | Mills et al. | |
| 2014/0186745 | A1 | 7/2014 | Metz et al. | |
| 2015/0337850 | A1 | 11/2015 | An et al. | |
| 2018/0306209 | A1 | 10/2018 | Nejedly et al. | |
| 2020/0347780 | A1 * | 11/2020 | Wengert | F02C 6/08 |
| 2021/0293254 | A1 * | 9/2021 | Chavez Castellanos | H02K 5/203 |

FOREIGN PATENT DOCUMENTS

| | | | |
|---|---|---|---|
| DE | 600 26 108 T2 | 8/2006 | |
| DE | 102010064061 A1 * | 8/2011 | F01D 25/16 |
| DE | 11 2012 002 901 T5 | 4/2014 | |
| EP | 1 041 699 B1 | 2/2006 | |

* cited by examiner

*Primary Examiner* — Kenneth J Hansen
(74) *Attorney, Agent, or Firm* — Bose McKinney & Evans LLP

(57) ABSTRACT

Disclosed is a compressor comprising a rotating assembly, which comprises a compressor wheel and a rotor of an electric motor, a stator of the electric motor, a bearing for the rotating assembly, a support that supports the bearing, and a cooling channel for purposes of cooling the electric motor. In accordance with this disclosure, a section of the cooling channel is arranged in the support.

12 Claims, 5 Drawing Sheets

COMPRESSOR

RELATED APPLICATIONS

This application claims priority to DE 10 2022 113 227.7, filed May 25, 2022, the entire disclosure of which is hereby incorporated herein by reference.

BACKGROUND

This disclosure relates to a compressor of the type generally known, for example, in DE 11 2012 002 901 T5. Compressors of this type are required, for example, for the efficient operation of fuel cells, to which compressed air must be supplied.

A compressor is a device for the compression of gases, and comprises a compressor wheel, which is driven by an electric motor, which has a rotor and a stator. Compressors may also contain other parts, in particular a turbine. The compressor wheel and rotor are part of a rotating assembly, which is supported by one or a plurality of bearings. For purposes of cooling of the electric motor, such compressors have a cooling channel, which usually runs along the stator of the electric motor.

SUMMARY

This disclosure demonstrates how the cooling of compressors can be improved.

In a compressor according to this disclosure, the cooling channel in which cooling liquid circulates during operation, not only runs along the electromagnet, but also has a section that runs in a support of a bearing of the rotating assembly. In this way, cooling fluid flowing through the cooling channel can not only cool the electric motor, but also efficiently dissipate frictional heat from the bearing.

In an advantageous refinement of this disclosure, provision is made for a section of the cooling channel in the support to come closer to a geometric axis of rotation of the rotating assembly, than in a main section of the cooling channel, which cools the electromagnet. In this way, the cooling channel can be routed past the bearing or bearings at an advantageously small distance, so that heat from cooling fluid flowing through the cooling channel can be removed particularly well.

In a further advantageous refinement of this disclosure, provision is made for the cooling channel in the support to have a radially inner section and a radially outer section. This allows cooling liquid to flow through the support particularly well, and heat to be dissipated from the support correspondingly efficiently. The radially inner section and the radially outer section of the cooling channel can be designed as sections arranged one above another, in particular as sections that lead around the rotating assembly, so that the direction of flow in the radially inner section is the same as that in the radially outer section. However, it is also possible for the radially outer section to consist of two curved sections, each of which extends over less than half the circumference, for example over 160° to 175°, and at the end of one section for a passage to lead to the radially inner section, which then extends over almost the entire circumference, for example over 330° to 350°, and is connected at its end to the other outer section. In such a configuration, the direction of flow in the outer section is the reverse of that in the inner section.

In a further advantageous refinement of this disclosure, provision is made for the cooling channel to have a plurality of C-shaped sections, between which the direction of flow is reversed. In the individual C-shaped sections, coolant therefore flows either clockwise around the electric motor, or counterclockwise, during operation. However, it is also possible that the direction of flow is not reversed; the coolant channel thus runs around the electric motor in a helical shape, for example. The C-shaped sections can be curved around the rotating assembly, in that, for example, they are shaped as circular arcs, whose centre lies on the geometric axis of rotation of the rotating assembly.

A compressor according to this disclosure can be designed as a charging device for a motor vehicle, or other mobile application. A compressor according to this disclosure can, for example, be used as a charging device, e.g., for a fuel cell or an internal combustion engine.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following description. Rather, the embodiments are chosen and described so that others skilled in the art may appreciate and understand the principles and practices of this disclosure.

Figure 1:
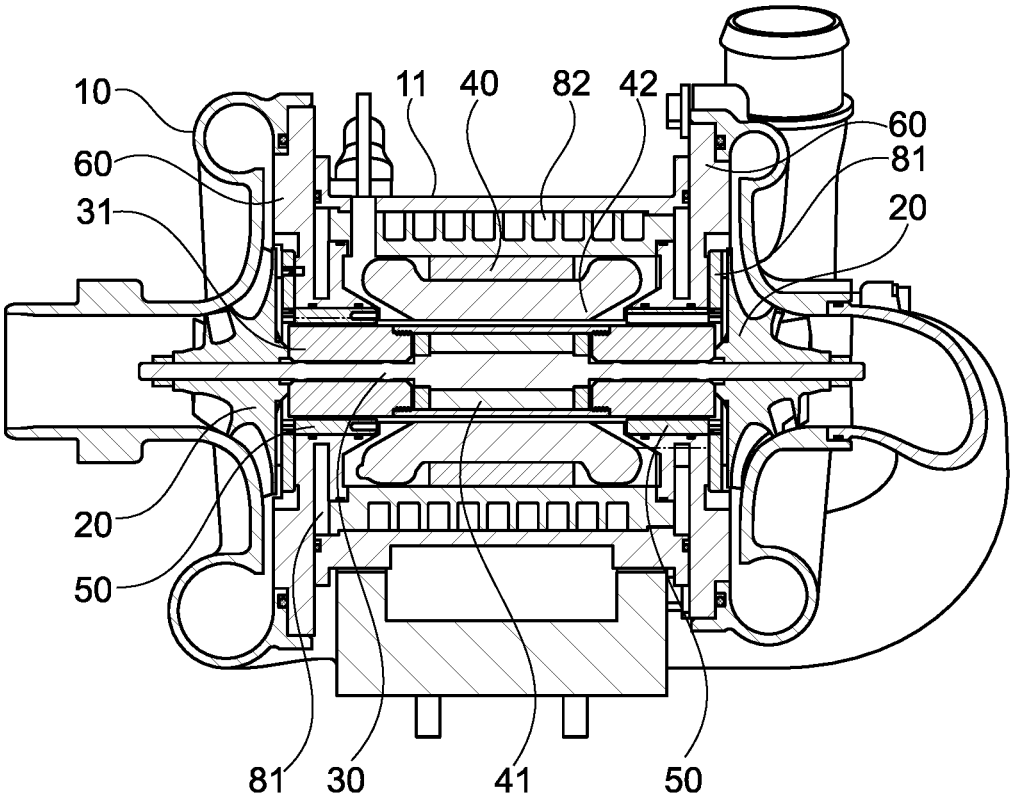
FIG. 1 shows a schematic sectional view of a compressor.

FIG. 1 shows schematically a compressor, which has a housing 10, in which are arranged a compressor wheel 20, a shaft 30, to which the compressor wheel 20 is attached, and an electric motor 40, which drives the shaft 30. The compressor shown comprises two compressor wheels 20, which are coupled to the shaft 30; however, the example of embodiment can also be modified such that the compressor has only a single compressor wheel 20.

The shaft 30, a rotor 41 of the electromagnet 40, the compressor wheels 20, and possibly other parts coupled to the shaft, form a rotating assembly 31, which is supported by bearings 50, for example one or a plurality of radial bearings, and/or one or a plurality of axial bearings. The bearings 50 are arranged on a support 60, which in the example of embodiment shown is designed as a compressor rear wall. The support 60 is arranged in each case between one of the compressor wheels 20 and the electric motor 40, and sits against a cylindrical part 11 of the housing 10.

Figure 2:
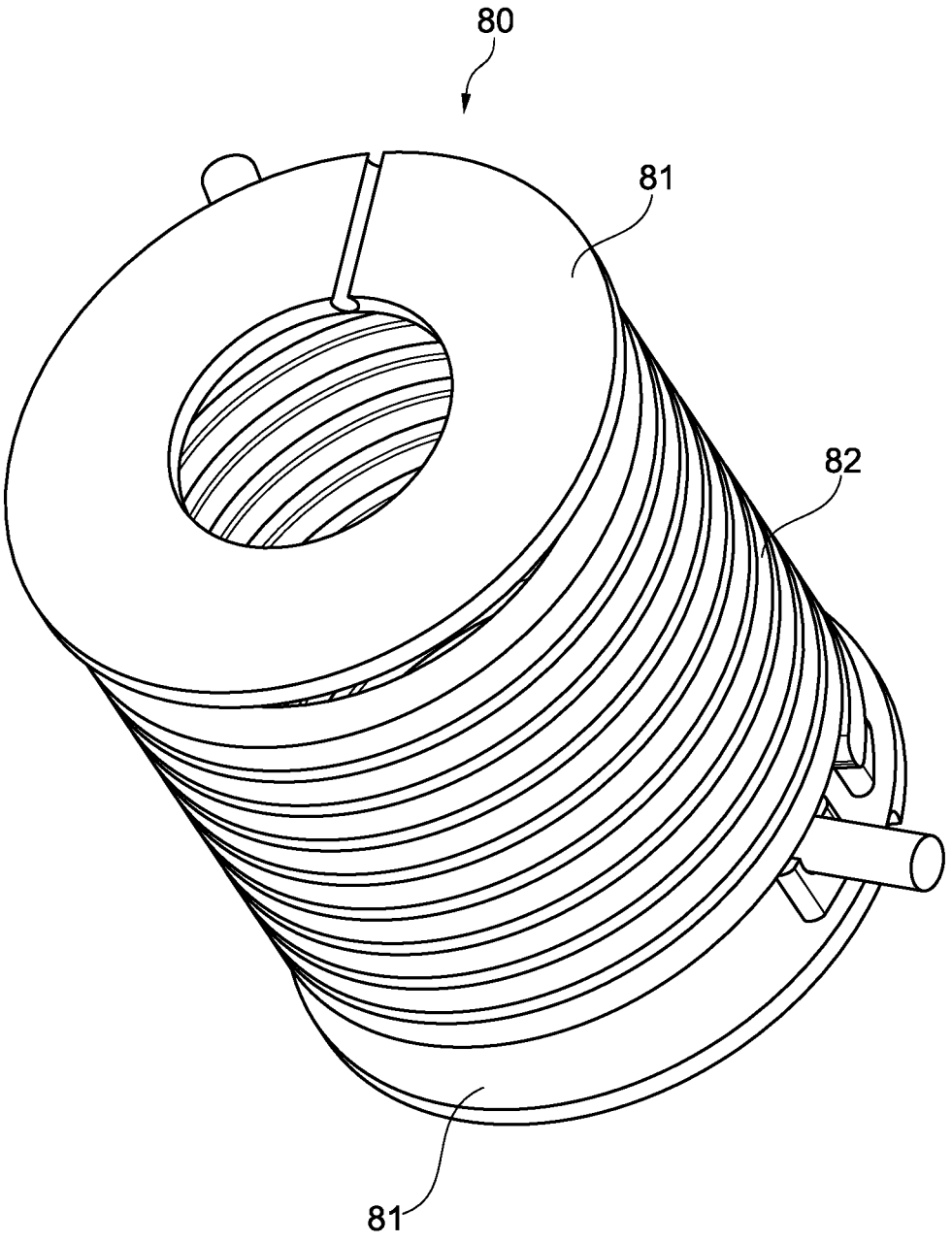
FIG. 2 shows a representation of the cooling channel of the compressor.
Figure 3:
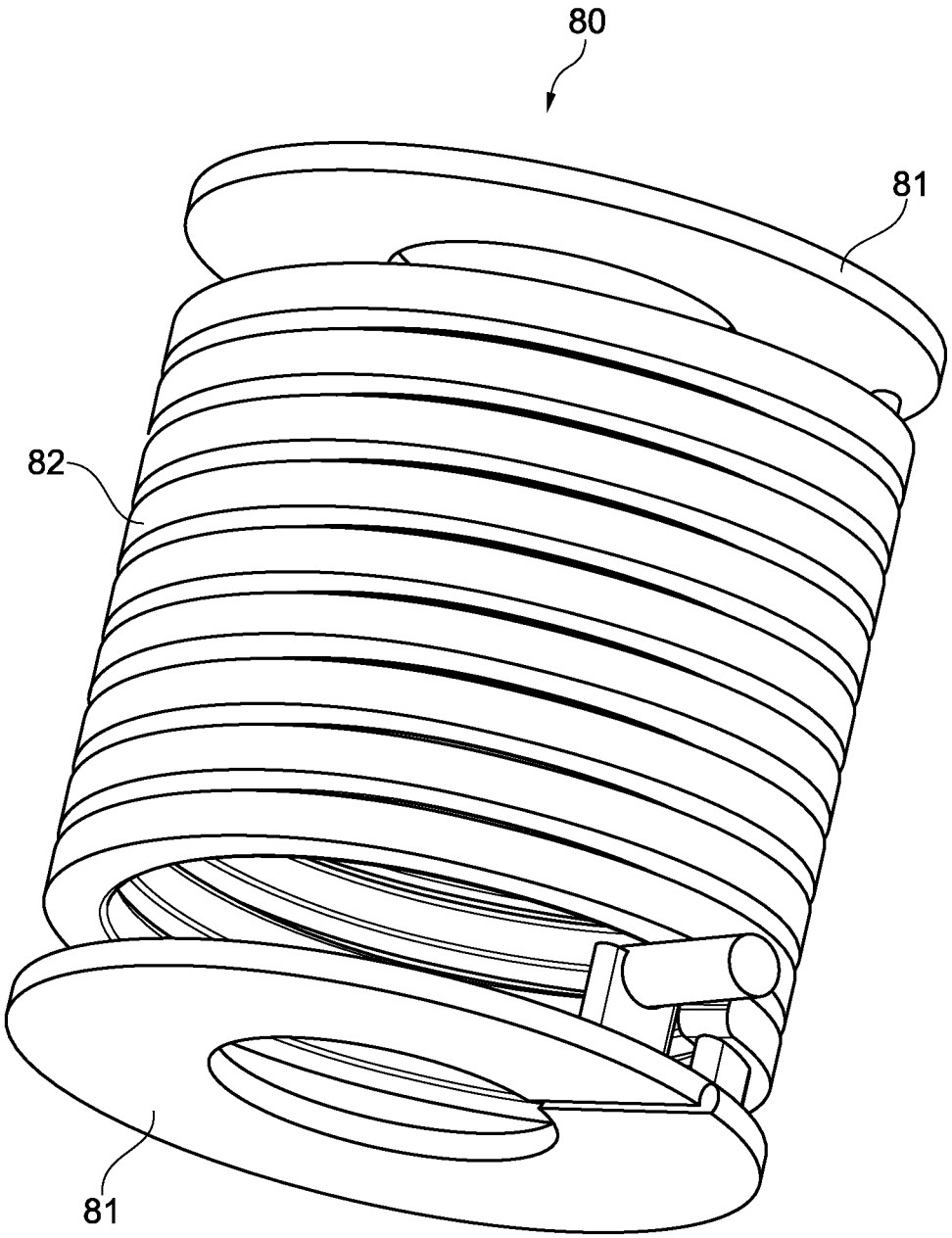
FIG. 3 shows another view of the cooling channel.
Figure 4:
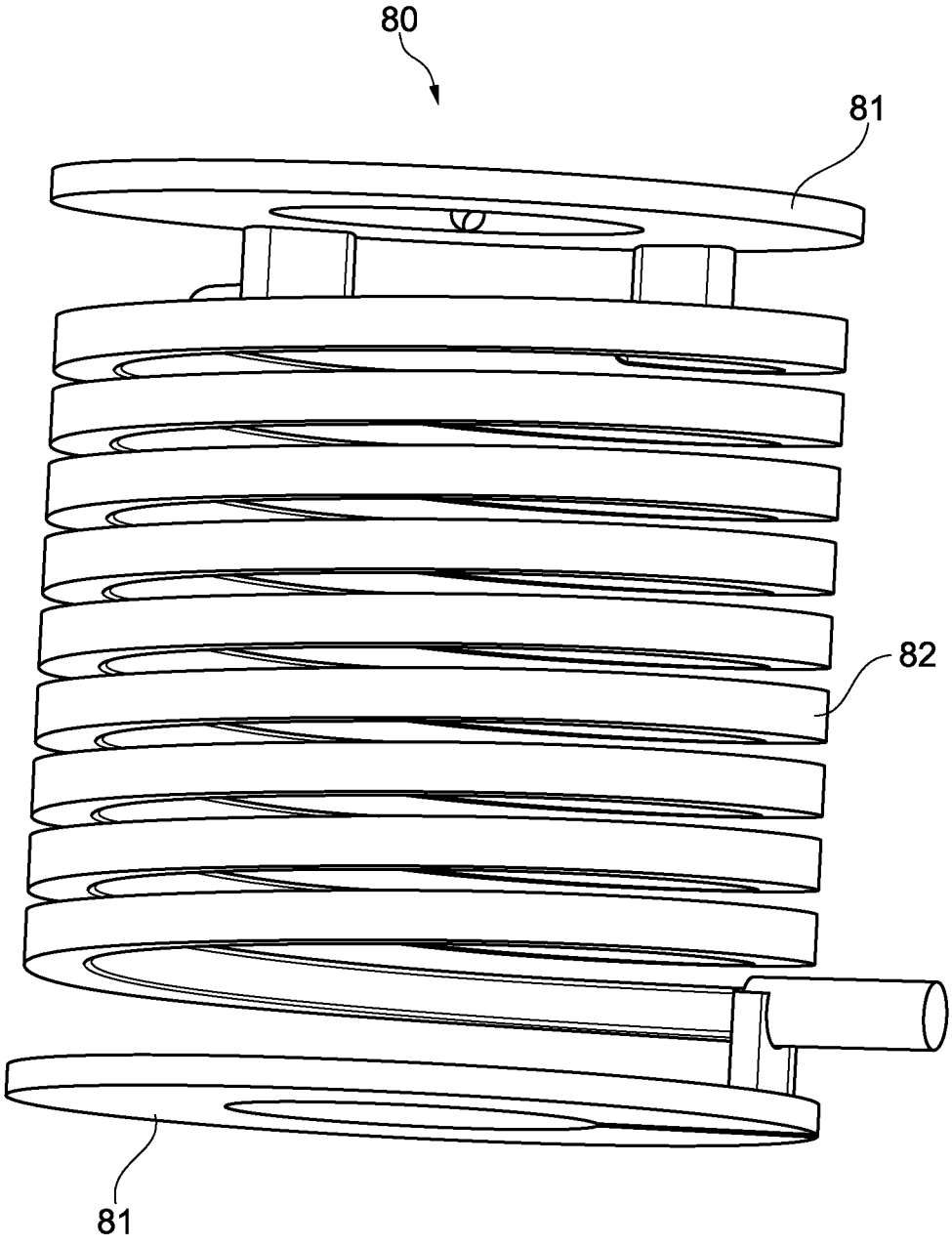
FIG. 4 shows another view of the cooling channel.
Figure 5:
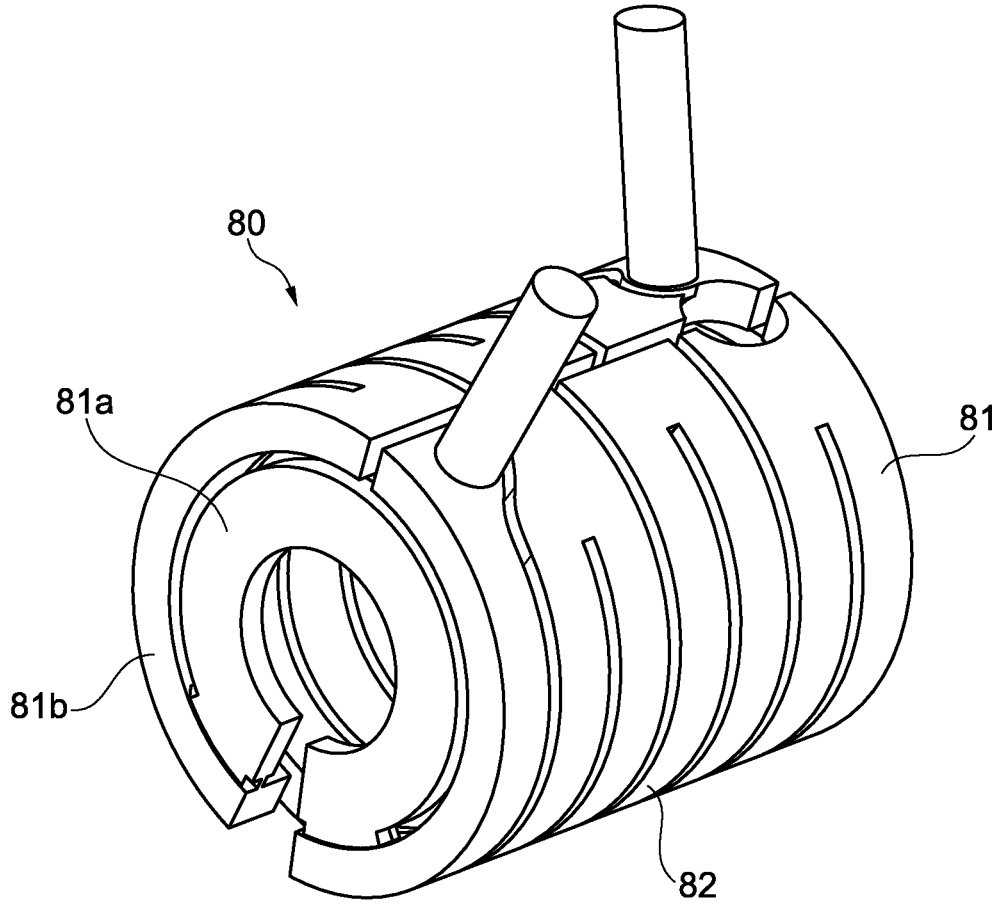
FIG. 5 shows another example of embodiment of a cooling channel for a compressor.

In operation, the compressor is cooled with cooling liquid, which flows through a cooling channel 80 that extends from one of the two supports 60, along the electromagnet 40, to the other support 60. FIGS. 2 to 4 show schematically a possible configuration of the shape of the cooling channel 80. FIG. 5 shows schematically an alternative configuration of a cooling channel.

In the examples of embodiment, the cooling channel 80 has a plurality of C-shaped sections that are curved around the rotating assembly. In the example of embodiment of FIG.

5, the flow direction in the cooling channel 80 is in each case reversed between adjacent C-shaped sections. In the example of embodiment of FIGS. 2 to 4, the C-shaped sections are connected to form a helix, so that the flow direction does not reverse, but can always lead clockwise, or always counterclockwise, around the rotating assembly.

The cooling channel 80 has a section 81, for example an initial section, in one of the two supports 60, an adjoining main section 82 on the stator 42 of the electric motor 40, for example between the housing part 11 circumferentially enclosing the stator and the stator 42, and a further section 81, in particular an end section, in the other of the two supports 60. An annular seal 70 is arranged between the housing part 11 and the support 60.

In the support 60, the cooling channel 80 comes much closer to the shaft 30, and thus to the geometric axis of rotation of the rotating assembly, than in the main section 82 that is routed around the electric motor 40. In the example shown, the radial distance from the rotating assembly 31 to the nearest part of the cooling channel 80 in the support 60 is less than half as large as that to the main section 82 of the cooling channel 80. In this way, frictional heat can be dissipated particularly well from the bearings 50 that are mounted on the support 60.

In the example of embodiment of FIG. 5, the cooling channel 80 in the support 60 has a radially inner section 81*a*, and a radially outer section 81*b*, stated more precisely, a C-shaped inner section 81*a*, and two C-shaped outer sections 81*b*. The inner C-shaped section extends over almost the full circumference, for example over 300° to 350°, while the two outer C-shaped sections 81*b* only extend over less than 180°, for example over 160° to 165°.

In operation, coolant first flows through an almost semicircular part of the outer section 81*b*, and from there radially inwards to the radially inner section 81*a*, in which coolant then flows in the opposite direction around almost the entire circumference of the shaft 30 to the second almost semicircular part of the radially outer section 81*b*. When coolant flows, for example, clockwise in the radially outer section 81*b*, the direction of flow in the radially inner section 81*a* is counterclockwise. The section 82 of the cooling channel 80 in the second support 60 can also be configured in a corresponding manner.

In both the example of embodiment of FIGS. 2 to 4, and the example of embodiment of FIG. 5, the cross-section of the cooling channel 80 in the support 60 has a different shape than that between the two supports 60. The end sections 81 of the cooling channel 80 thus have a shape that differs from that of the main section 82.

In the example of embodiment of FIGS. 2 to 4, the sections 81 of the cooling channel 80 in the support 60 are thinner in the axial direction and wider in the radial direction. In the example of FIG. 5, the cross-sectional area of the radially inner section 81*a* of the cooling channel 80 has a lesser extent in the axial direction than the cross-sectional area of C-shaped sections of the cooling channel that is curved around the stator 42 of the electromagnet 40. In addition, the cross-sectional area of the radially inner section 81*a* of the cooling channel 80 in FIG. 5 has a greater extent in the radial direction than the cross-sectional area of C-shaped sections of the cooling channel that are curved around the stator 42 of the electromagnet 40. In this way, the cooling channel 80 can be routed even closer to the rotating assembly 31, and thus to the bearings 50.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE SYMBOLS

10 Housing
11 Housing part
20 Compressor wheel
30 Shaft
40 Electric motor
41 Rotor
42 Stator
50 Bearing
60 Support
70 Annular seal
80 Cooling channel
81 Channel section
81*a* Radially inner channel section
81*b* Radially outer channel section
82 Channel section
83 Channel section

What is claimed is:

1. A compressor, comprising:

a rotating assembly having a compressor wheel and a rotor of an electric motor;

a stator of the electric motor;

a bearing of the rotating assembly;

a support that supports the bearing; and a cooling channel configured for cooling the electric motor, wherein a section of the cooling channel is arranged in the support, the section of the cooling channel in the support having a first sub-section and a second sub-section wherein the first sub-section is arranged radially inwards from the second sub-section, and wherein the first sub-section is C-shaped and extends circumferentially in a range greater than 300° and no more than 350° and the second sub-section is defined by two C-shaped outer sections which each extend circumferentially in a range greater than 160° and no more than 175°.

2. The compressor according to claim 1, wherein the section of the cooling channel in the support comes closer to a geometric axis of rotation of the rotating assembly than another section of the cooling channel running along the stator.

3. The compressor according to claim 1, wherein the first sub-section and the second sub-section of the cooling channel in the support are curved around the rotating assembly.

4. The compressor according to claim 3, wherein at least one of the C-shaped sections of the first sub-section and the second sub-section in the support has a cross-section having a lesser length in the axial direction, and a greater length in the radial direction, than a cross-section of a C-shaped sub-section of the cooling channel that is curved around the stator of the electric motor.

5. The compressor according to claim 1, wherein the direction of flow of cooling liquid in the first sub-section is the reverse of the flow of cooling liquid in the second sub-section.

6. The compressor according to claim 1, further comprising an annular seal arranged between the support and a housing part that surrounds the electric motor.

7. The compressor according to claim 1, wherein the support comprises a compressor rear wall.

8. The compressor according to claim 1, wherein the cooling channel has a plurality of sections between which the direction of flow is reversed.

9. The compressor according to claim 1, wherein the cooling channel runs helically around the rotating assembly.

10. The compressor according to claim 1, wherein the compressor is configured as a charging device for a mobile application.

11. The compressor according to claim 1, wherein the compressor is configured for charging a fuel cell or an internal combustion engine.

12. A compressor, comprising:

a rotating assembly having a compressor wheel and a rotor of an electric motor;

a stator of the electric motor;

a bearing of the rotating assembly;

a support that supports the bearing; and a cooling channel configured for cooling the electric motor, wherein a section of the cooling channel is arranged in the support, the section of the cooling channel in the support having a first sub-section and a second sub-section wherein the first sub-section is arranged radially inwards from the second sub-section, and wherein the first sub-section is C-shaped and extends circumferentially in a range greater than 300° and no more than 350° and the second sub-section is defined by two C-shaped outer sections which each extend circumferentially in a range greater than 160° and no more than 175°; and wherein a main section of the cooling channel disposed about the stator of the electric motor comprises a plurality of C-shaped sections between which the direction of flow is reversed.

* * * * *